US010371395B2

(12) United States Patent
Rite et al.

(10) Patent No.: US 10,371,395 B2
(45) Date of Patent: Aug. 6, 2019

(54) SYSTEM AND METHOD FOR A COMPRESSOR DOME TEMPERATURE SENSOR LOCATION VERIFICATION

(71) Applicant: Trane International Inc., Piscataway, NJ (US)

(72) Inventors: Raymond Walter Rite, Tyler, TX (US); Don Alan Schuster, Lindale, TX (US)

(73) Assignee: Trane International Inc., Piscataway, NJ (US)

( * ) Notice: Subject to any disclaimer, the term of this patent is extended or adjusted under 35 U.S.C. 154(b) by 617 days.

(21) Appl. No.: 14/721,721

(22) Filed: May 26, 2015

(65) Prior Publication Data

US 2015/0345813 A1 Dec. 3, 2015

Related U.S. Application Data

(60) Provisional application No. 62/007,304, filed on Jun. 3, 2014.

(51) Int. Cl.

| | |
|---|---|
| ***F24F 1/08*** | (2011.01) |
| ***F24F 5/00*** | (2006.01) |
| ***F24F 11/30*** | (2018.01) |
| ***F24F 11/62*** | (2018.01) |
| *F24F 110/00* | (2018.01) |

(52) U.S. Cl.

CPC ..... *F24F 5/001* (2013.01); *F24F 1/08* (2013.01); *F24F 11/30* (2018.01); *F24F 11/62* (2018.01); *F24F 2110/00* (2018.01)

(58) Field of Classification Search

CPC .... F24F 11/001; F24F 11/006; F24F 11/0012; F24F 11/0013; G06Q 20/202–203

USPC ..... 374/15, 30, 137, 141, 110

See application file for complete search history.

(56) References Cited

U.S. PATENT DOCUMENTS 6,549,891 B1 * 4/2003 Rauber ..... G06Q 10/08 705/22
6,652,238 B2 * 11/2003 Kajiwara ..... F04C 28/08 417/44.1
8,321,302 B2 * 11/2012 Bauer ..... G06K 7/0008 705/28

(Continued)

*Primary Examiner* — Filip Zec

(74) *Attorney, Agent, or Firm* — Conley Rose, P.C.; J. Roberts Brown, Jr.

(57) ABSTRACT

Systems and methods are disclosed herein that include controlling operation of a heating, ventilation, and/or air conditioning (HVAC) system that utilizes information from a plurality of temperature sensors to monitor, verify, determine, and/or discover whether a temperature sensor is properly located in proximity to a dome of a compressor of the HVAC system. When the HVAC system determines that the temperature sensor associated with the dome of the compressor is not properly located, the HVAC system may initiate a shutdown of the compressor and/or other components of the HVAC system, generate a signal, present a message, and/or otherwise provide a notification of the improper temperature sensor placement, and/or reduce a runtime of the compressor, operate the compressor at a lower speed, reduce a power consumption of the compressor, and/or otherwise control the compressor and/or associated components to effectuate a reduced compressor dome temperature.

22 Claims, 7 Drawing Sheets

(56) References Cited

U.S. PATENT DOCUMENTS

| | | | | |
|---|---|---|---|---|
| 2002/0038081 | A1* | 3/2002 | Fein | A61B 5/14552 600/323 |
| 2002/0072809 | A1* | 6/2002 | Zuraw | G05B 19/0428 700/9 |
| 2003/0223473 | A1* | 12/2003 | Unger | F01P 11/00 374/141 |
| 2006/0041335 | A9* | 2/2006 | Rossi | G05B 23/0235 700/276 |
| 2011/0132007 | A1* | 6/2011 | Weyna | F25B 49/027 62/115 |
| 2015/0173129 | A1* | 6/2015 | Tils | H05B 6/6452 374/1 |
| 2015/0177107 | A1* | 6/2015 | Song | G01H 9/004 73/649 |
| 2016/0265798 | A1* | 9/2016 | Havard, Jr. | F24F 11/001 |

* cited by examiner

PARAMETERS:

| | NAME | DESCRIPTION | VALUE RANGE | RESOLUTION | DEFAULT |
|---|---|---|---|---|---|
| | Min_on_sensor | MINIMUM ON TIME REQUIRED TO PERFORM ON CYCLE SENSOR CHECK | 0-18000 SEC | 1 | 120 |
| 156 | CDTS_AMB_DT_CLG | SENSOR APPLICATION VALUE OUT OF RANGE CHECK OF Dome_Temp TO Amb_Temp IN COOLING | 5-50F | 1 | 15 |
| 152 | CDTS_ODT_DT_CLG | SENSOR APPLICATION VALUE OUT OF RANGE CHECK OF Dome_Temp TO OD_Coil_Temp IN COOLING | 5-50F | 1 | 15 |
| 154 | CDTS_STS_DT_CLG | SENSOR APPLICATION VALUE OUT OF RANGE CHECK OF Dome_Temp TO Suct_Temp IN COOLING | 5-50F | 1 | 15 |
| 156 | CDTS_AMB_DT_HTG | SENSOR APPLICATION VALUE OUT OF RANGE CHECK OF Dome_Temp TO Amb_Temp IN HEATING | 5-50F | 1 | 20 |
| 152 | CDTS_ODT_DT_HTG | SENSOR APPLICATION VALUE OUT OF RANGE CHECK OF Dome_Temp TO OD_Coil_Temp IN HEATING | 5-50F | 1 | 20 |
| 154 | CDTS_STS_DT_HTG | SENSOR APPLICATION VALUE OUT OF RANGE CHECK OF Dome_Temp TO Suct_Temp IN HEATING | 5-50F | 1 | 20 |

FIG. 4

GENERAL RELATIONSHIPS:

| MODE | RULE | SENSOR 1 | SENSOR 2 | RELATIONSHIP |
|---|---|---|---|---|
| COOLING | 1 | Dome_Temp | Amb_Temp | Dome_Temp < Amb_Temp + CDTS_AMB_DT_CLG |
| COOLING | 2 | Dome_Temp | OD_Coil_Temp* | Dome_Temp < OD_Coil_Temp + CDTS_ODT_DT_CLG |
| COOLING | 3 | Dome_Temp | Suct_Temp | Dome_Temp < Suct_Temp + CDTS_STS_DT_CLG |
| HEATING | 1 | Dome_Temp | Amb_Temp | Dome_Temp < Amb_Temp + CDTS_AMB_DT_HTG |
| HEATING | 2 | Dome_Temp | OD_Coil_Temp | Dome_Temp < OD_Coil_Temp + CDTS_ODT_DT_HTG |
| HEATING | 3 | Dome_Temp | Suct_Temp | Dome_Temp < Suct_Temp + CDTS_STS_DT_HTG |

* AC DOES NOT HAVE OD_Coil_Temp
NEED TO FACTOR THIS INTO CODING

FIG. 5

```
        IF (Rule 1 = TRUE) THEN XX_Count = XX_Count + 1
        IF (Rule 2 = TRUE) THEN XX_Count = XX_Count + 1
        IF (Rule 3 = TRUE) THEN XX_Count = XX_Count + 1
IF (XX_Count >= 2) THEN XX_App_Flag = TRUE
```

NEW ALARM:

| ALERT | DESCRIPTION | CAUSE |
|---|---|---|
| Dome_Temp_App_Flag | TRUE: OUT OF AGREEMENT WITH OTHER SENSORS | DOME TEMPERATURE SENSOR NOT INSTALLED PROPERLY |

FIG. 6

SYSTEM AND METHOD FOR A COMPRESSOR DOME TEMPERATURE SENSOR LOCATION VERIFICATION

CROSS-REFERENCE TO RELATED APPLICATIONS

The present application claims priority under 35 U.S.C. § 119(e) to U.S. Provisional Patent Application No. 62/007,304 filed on Jun. 3, 2014 by Rite, et. al. and entitled "System and Method for Sensor Location Verification," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some heating, ventilating, and air conditioning (HVAC) systems comprise sensors to assist with control and/or monitoring of the HVAC system operation. In some cases, temperature sensors are used to provide temperature information regarding a compressor of the HVAC system. The utility of some temperature sensors associated with providing compressor temperature information is dependent upon proper physical location of the temperature sensors relative to the compressor.

SUMMARY

In some embodiments of the disclosure, a heating, ventilating, and air conditioning (HVAC) system is disclosed as comprising: a compressor; a compressor dome temperature sensor; a plurality of additional temperature sensors; and a controller configured to control operating of the HVAC system in response to comparisons of information from the compressor dome temperature sensor and the plurality of additional temperatures sensors indicating a likelihood that the compressor dome temperature sensor is not properly located.

In other embodiments of the disclosure, method of operating an HVAC system is disclosed as comprising: providing a compressor; measuring a compressor dome temperature; measuring a plurality of other temperatures; comparing the compressor dome temperature to the plurality of other temperatures; and controlling operation of the HVAC system in response to the comparing the compressor dome temperature to the other temperatures indicating a likelihood that the compressor dome temperature sensor is not properly located.

In yet other embodiments of the disclosure, a controller for a heating, ventilating, and air conditioning (HVAC) system is disclosed as comprising: at least one processor configured to monitor a compressor dome temperature; monitor a plurality of other temperatures; compare the compressor dome temperature to the plurality of other temperatures; and control operation of a compressor of the HVAC system in response to comparing the compressor dome temperature to the other temperatures indicating a likelihood that the compressor dome temperature sensor is not properly located.

BRIEF DESCRIPTION OF THE DRAWINGS

For a more complete understanding of the present disclosure and the advantages thereof, reference is now made to the following brief description, taken in connection with the accompanying drawings and detailed description:

FIG. 4 is a table of temperature sensor comparison parameters;

FIG. 5 is a table of comparison rules associated with the comparison parameters of FIG. 4;

FIG. 6 is a table of counting rules associated with the comparison rules of FIG. 5;

Herein, like elements and features are marked throughout the disclosure and drawings with the same reference numerals, respectively.

DETAILED DESCRIPTION

In some embodiments disclosed herein, a heating, ventilation, and/or air conditioning (HVAC) system and method for controlling operation of an HVAC system is provided that utilizes information from a plurality of temperature sensors to monitor, verify, determine, and/or discover whether a temperature sensor is properly located on a dome and/or substantially in close proximity to the dome of a compressor of the HVAC system to prevent the compressor from exceeding a maximum allowable operating temperature. In some embodiments, when the HVAC system determines that the temperature sensor associated with the dome of the compressor is not properly located, the HVAC system may initiate a shutdown of the compressor and/or other components of the HVAC system. In alternative embodiments, when the HVAC system determines that the temperature sensor associated with the dome of the compressor is not properly located, the HVAC system may generate a signal, present a message, and/or otherwise provide a notification of the improper temperature sensor placement. In alternative embodiments, rather than shutting down the compressor in response to a determination that the temperature sensor associated with the dome of the compressor is improperly placed, the HVAC system may reduce a runtime of the compressor, operate the compressor at a lower speed, reduce a power consumption of the compressor, and/or otherwise control the compressor and/or associated components to effectuate a reduced compressor dome temperature.

In some embodiments, if a comparison of a dome temperature sensor output fails to have an expected value relative to at least two other temperature sensors, the HVAC system may alter operation of the compressor to reduce an opportunity for the compressor to overheat.

Figure 1:
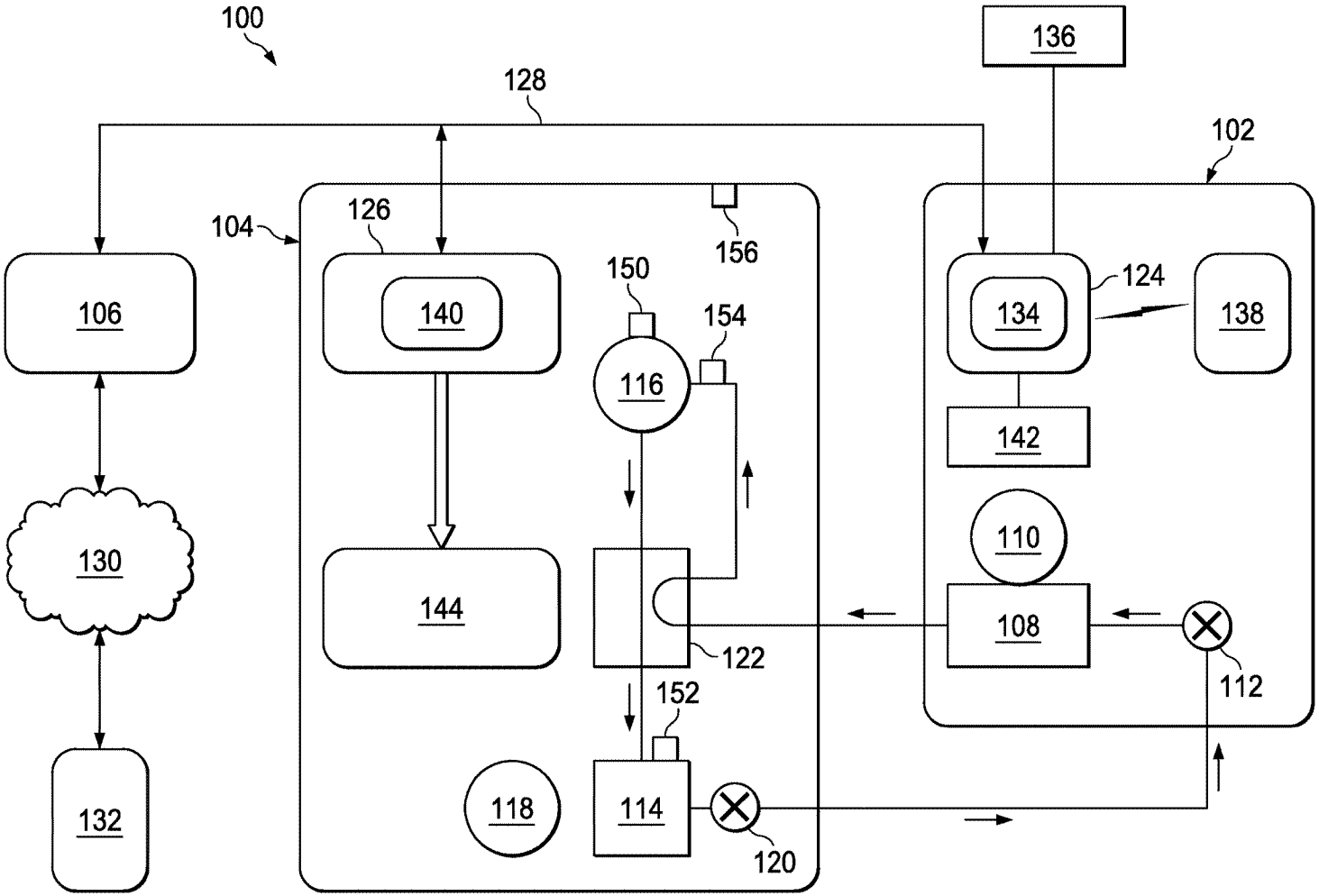
FIG. 1 is a schematic diagram of an HVAC system according to an embodiment of the disclosure.
Figure 2:
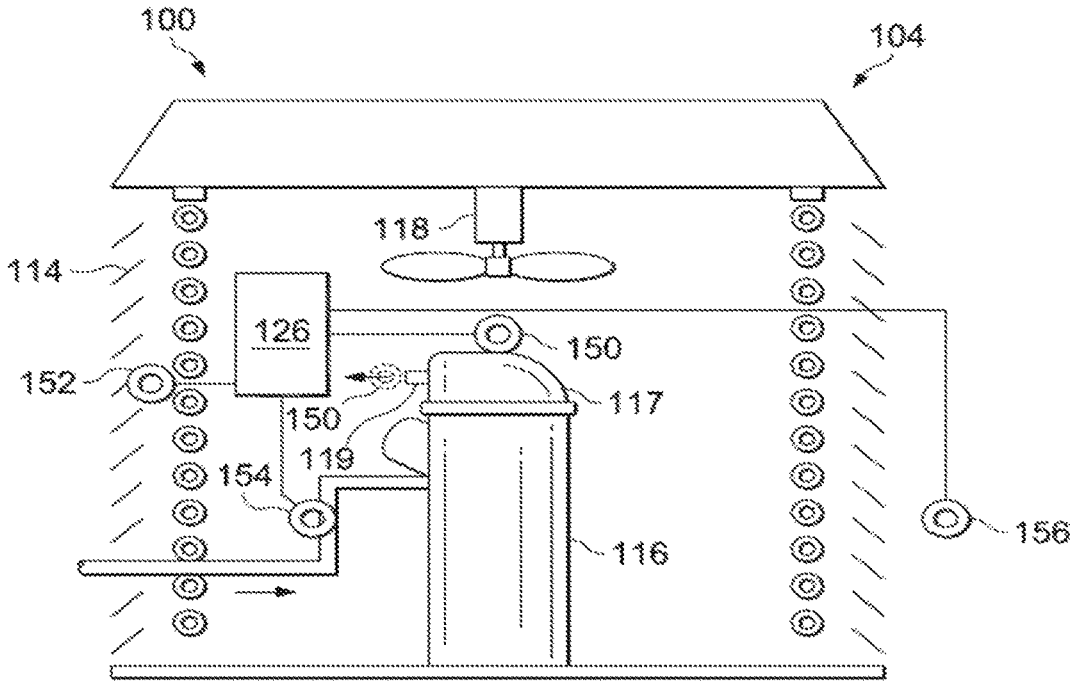
FIG. 2 is a schematic diagram of an outside unit of the HVAC system of FIG. 1.

Referring to FIGS. 1 and 2, schematic diagrams of a heating, ventilating, and/or air conditioning (HVAC) system 100 according to an embodiment of the present disclosure are shown. The HVAC system 100 comprises an indoor unit 102, an outdoor unit 104, and a system controller 106, which may be configured to control operation of the indoor unit 102 and/or the outdoor unit 104. The HVAC system 100 may generally be described as a heat pump system that selectively operates to implement one or more substantially closed thermodynamic refrigeration cycles to provide a cooling and/or heating functionality.

The indoor unit 102 may comprise an indoor heat exchanger 108, an indoor fan 110, and an indoor metering device 112. In one aspect, the indoor heat exchanger 108 may be a plate fin heat exchanger configured to allow heat exchange between refrigerant carried within internal tubing of the indoor heat exchanger 108 and fluids that contact the indoor heat exchanger 108 but that are kept segregated from the refrigerant. In other aspects, the indoor heat exchanger 108 may comprise a spine fin heat exchanger, a microchannel heat exchanger, or any other suitable type of heat exchanger.

In an embodiment, the indoor fan 110 may be a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. Additionally or alternatively, the indoor fan 110 may be configured as a modulating and/or variable speed fan capable of being operated at many speeds over one or more ranges of speeds. In one aspect, the indoor fan 110 may be configured as a multi-speed fan capable of being operated at a plurality of operating speeds. For example, the indoor fan 110 may selectively power different windings selected from multiple electromagnetic windings of a motor that drives the indoor fan 110. In other aspects, the indoor fan 110 may be a single-speed fan.

In an embodiment, the indoor unit 102 may comprise a metering device 112, which may include an electronically controlled electronic expansion valve (EEV) driven by a motor. In some aspects, the indoor metering device 112 may include a thermostatic expansion valve, a capillary tube assembly, and/or any other suitable metering device. Additionally or alternatively, the indoor metering device 112 may comprise and/or be associated with a refrigerant check valve and/or a refrigerant bypass for use when a direction of refrigerant flow through the indoor metering device 112 is such that the indoor metering device 112 is not intended to meter or otherwise substantially restrict flow of the refrigerant through the indoor metering device 112.

The outdoor unit 104 may comprise an outdoor heat exchanger 114, a compressor 116, an outdoor fan 118, an outdoor metering device 120, and a reversing valve 122. The outdoor heat exchanger 114 may be a micro-channel heat exchanger configured to allow heat exchange between refrigerant carried within internal passages of the outdoor heat exchanger 114 and fluids that contact the outdoor heat exchanger 114 but are kept segregated from the refrigerant. In other implementations, the outdoor heat exchanger 114 may comprise a spine fin heat exchanger, a plate fin heat exchanger, or any other suitable type of heat exchanger.

In an embodiment, the compressor 116 may be a multi-speed scroll type compressor configured to selectively pump refrigerant at a plurality of mass flow rates. In some aspects, the compressor 116 may comprise a modulating compressor capable of operating over one or more speed ranges. Further still, the compressor 116 may comprise a reciprocating type compressor, a single speed compressor, and/or any other suitable refrigerant compressor and/or refrigerant pump.

In an embodiment, the outdoor fan 118 may be an axial fan comprising a fan blade assembly and a fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 may be configured as a modulating and/or variable speed fan capable of running at many speeds over one or more speed ranges. Analogous to the indoor fan 110, the outdoor fan 118 may be configured as a multi-speed fan capable of running at a plurality of operating speeds. In other embodiments, the outdoor fan 118 may be a single speed fan.

In an embodiment, the outdoor metering device 120 may be a thermostatic expansion valve. In other embodiments, the outdoor metering device 120 may comprise an electronically controlled motor driven EEV, a capillary tube assembly, and/or any other suitable metering device. Analogous to the indoor metering device 112, the outdoor metering device 120 may comprise and/or be associated with a refrigerant check valve and/or refrigerant bypass for use when a direction of refrigerant flowing through the outdoor metering device 120 is such that the outdoor metering device 120 is not intended to meter or substantially restrict the flow of refrigerant.

In an embodiment, the reversing valve 122 may be a so-called four-way reversing valve. The reversing valve 122 may be selectively controlled to alter a path of refrigerant flowing in the HVAC system 100. Additionally or alternatively, the reversing valve 122 may comprise an electrical solenoid and/or other suitable device (e.g., electromagnetic actuators and switches) configured to selectively move a component of the reversing valve 122 between operational positions.

In an embodiment, the system controller 106 may comprise a graphical user interface (GUI) for displaying information and for receiving user inputs. The system controller 106 may display information related to the operation of the HVAC system 100 and may receive user inputs related to operation of the HVAC system 100. The system controller 106 may further be operable to display information and receive user inputs tangentially and/or unrelated to operation of the HVAC system 100. Moreover, the system controller 106 may selectively communicate with an indoor controller 124 of the indoor unit 102, with an outdoor controller 126 of the outdoor unit 104, and/or with other components of the HVAC system 100.

In an embodiment, the system controller 106 may be configured for selective bidirectional communication over a communication bus 128. In one aspect, portions of the communication bus 128 may comprise a single- or multi-wire connection suitable for communicating messages between the system controller 106 and one or more of the HVAC system 100 components interfaced to the communication bus 128. Moreover, the system controller 106 may be configured to selectively communicate with HVAC system 100 components and/or other communication devices 132 via a communication network 130. For example, the communication network 130 may comprise a telephone network and a communication device 132 may comprise a telephone.

Additionally or alternatively, the communication network 132 may comprise or be communicatively linked to the Internet. Furthermore, the communication devices 130 may comprise a so-called smartphone and/or any other suitable mobile telecommunication device.

The indoor controller 124 may be carried by the indoor unit 102 and may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. Similarly, the indoor controller 124 may be configured to communicate with an indoor fan controller 142 and/or otherwise affect control over operation of the indoor fan 110. Furthermore, the indoor personality module 134 may comprise information related to the identification and/or operation of the indoor unit 102.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104.

In an embodiment, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120.

In some embodiments, the outdoor controller 126 may communicate with a compressor drive controller 144 that is configured to electrically power and/or control the compressor 116. In some embodiments, the outdoor controller 126 and the compressor drive controller 144 may be integrated as a single unit capable of singularly performing the same functionality as each controller 126 and 144.

In some embodiments, the indoor controller 124 may be configured to communicate with and/or otherwise control operation of the compressor 116. For example, the indoor controller 124 may be configured for connection with the compressor 116 via low voltage control wiring that may be used to affect a power level of the compressor 116 (or motor thereof). In other embodiments, the compressor 116 may be configured for communication with the system controller 106 via the indoor controller 124, via the communication bus 128, and/or any other suitable device and/or communication medium so that the system controller 106 may communicate with and/or otherwise control operation of the compressor 116. Of course, in alternative embodiments, the compressor 116 and/or the indoor fan 110 may be controlled by any other suitable component and/or via any suitable communication medium.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering device 112 through and/or around the outdoor metering device 120 such that the flow of refrigerant in the cooling mode is not substantially impeded. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to gaseous phase. The gaseous phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. The refrigerant may thereafter reenter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

In this embodiment, the HVAC system 100 further comprises a plurality of temperature sensors configured to communicate temperature information to at least one of the system controller 106 and the outdoor controller 126. In some embodiments, the system controller 106 and/or the outdoor controller 126 may receive the temperature information and convert the temperature information into temperature values, such as degrees Fahrenheit, that may be utilized in algorithmic calculations, logical comparisons, and/or the like. In some embodiments, the temperature sensors may be configured to communicate temperature information from the outdoor controller 126 to the system controller 106 via the communication bus 128. In this embodiment, the HVAC system 100 comprises a compressor dome temperature sensor 150, an outdoor heat exchanger temperature sensor 152, a suction line temperature sensor 154, and an outdoor ambient temperature sensor 156. In some embodiments, the compressor dome temperature sensor 150 may generally be associated with a top end of the exterior of the compressor 116. However, in some embodiments, the compressor dome temperature sensor 150 (shown as a dashed circle on FIG. 2) may be attached and/or associated with a compressor discharge line 119 that is substantially located in close proximity to the top end of the compressor 116. In this embodiment, one or more of the temperature sensors 150, 152, 154, 156 may comprise a thermistor type sensor. However, in alternative embodiments, any other suitable type of temperature sensing device, such as a laser based thermometer, may be used to generate and/or provide the temperature information.

Figure 3:
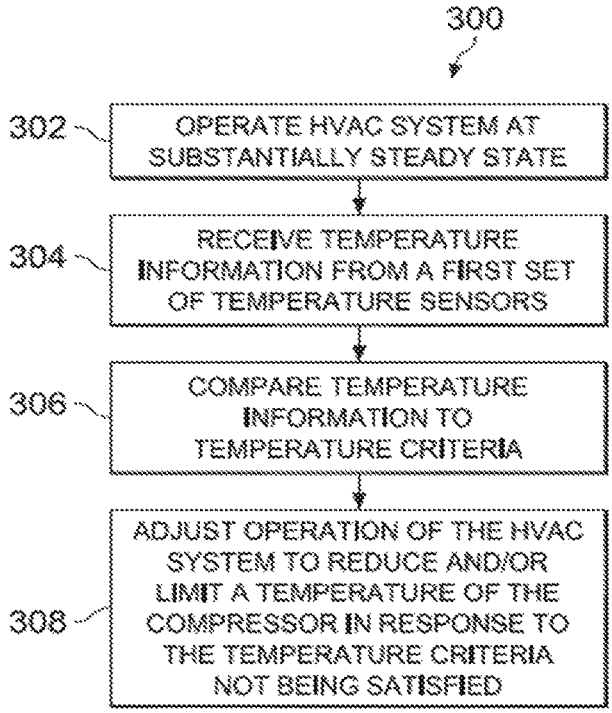
FIG. 3 is a flowchart of a method of operating an HVAC system according to an embodiment of the disclosure.

Referring now to FIG. 3, a simplified flowchart of a method 300 of controlling an HVAC system such as HVAC system 100 is shown. At block 302, the HVAC system may be operated at substantially a steady state so that the compressor of the HVAC system has achieved a substantially steady state temperature. In some cases, an HVAC system may be assumed to have achieved a steady state operation after at least about five minutes of operation to meet a cooling or heating demand. At block 304, a controller of the HVAC system may receive temperature information from a first set of temperature sensors. In some embodiments, the first set of temperature sensors may comprise temperature sensors substantially similar to temperature sensors 150, 152, 154, 156. At block 306, the method 300 may utilize the temperature information by applying temperature criteria to determine whether the temperature criteria are satisfied. At block 308, the method 300 may adjust operation of the HVAC system to reduce and/or limit a temperature of the compressor in response to the temperature criteria not being satisfied.

Referring now to FIG. 4, a table of temperature comparison parameters are provided for the temperature sensors 152, 154, 156 for each of a cooling mode of operation and a heating mode of operation. In FIG. 4, the Dome_Temp variable represents a temperature value in degrees Fahrenheit associated with the temperature information provided by the compressor dome temperature sensor 150, the Amb_Temp variable represents a temperature value in degrees Fahrenheit associated with the temperature information provided by the outdoor ambient temperature sensor 156, the OD_Coil_Temp variable represents a temperature value in degrees Fahrenheit associated with the temperature information provided by the outdoor heat exchanger temperature sensor 152, and the Suct_Temp variable represents a temperature value in degrees Fahrenheit associated with the temperature information provided by the suction line temperature sensor 154.

Referring now to FIG. 5, a table of comparison rules is provided. Most generally, the values of the parameters of FIG. 4 may be utilized in the comparison rules of FIG. 5 to determine whether the comparison rules yield TRUE or FALSE answers. In this embodiment, a comparison rule that yields a TRUE answer may be generally associated with the comparison rule indicating a possible failure with regard to whether the compressor dome temperature sensor 150 is properly located relative to the compressor dome 117. Referring now to FIG. 6, a table of counting rules is provided. Most generally, the counting rules are utilized to track how many of the comparison rules yield a TRUE value (i.e. generally indicate that the compressor dome temperature sensor 150 is not properly located relative to the compressor dome 117). In this embodiment, if two or more TRUE values are counted by the counting rules, an alert may be issued and/or an action may be taken to indicate that the compressor dome temperature sensor 150 is not properly located and/or to otherwise take action to prevent damage to the compressor which may result from the compressor temperature not being properly monitored.

Figure 7:
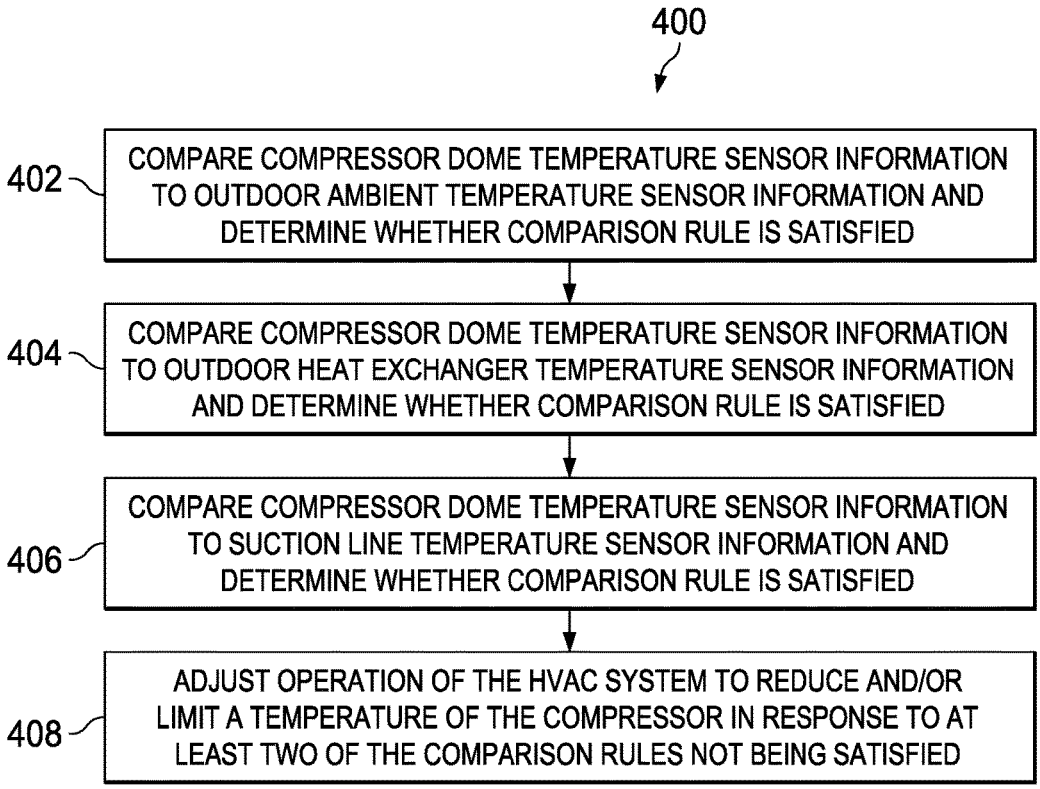
FIG. 7 is a flowchart of a method of operating an HVAC system according to another embodiment of the disclosure.

Referring to FIG. 7, a flowchart of a method 400 of operating an HVAC system according to another embodiment is shown. The method 400 may begin at block 402 by comparing compressor dome temperature sensor information to outdoor ambient temperature sensor information, such as by applying the comparison rules of FIG. 5 utilizing the comparison parameters of FIG. 4. The method 400 may continue at block 404 by comparing compressor dome temperature sensor information to outdoor heat exchanger temperature sensor information, such as by applying the comparison rules of FIG. 5 utilizing the comparison parameters of FIG. 4. The method 400 may continue at block 406 by comparing compressor dome temperature sensor information to suction line temperature sensor information, such as by applying the comparison rules of FIG. 5 utilizing the comparison parameters of FIG. 4. In some embodiments, the method 400 may continue at block 408 by determining, such as according to the counting rules of FIG. 6, whether at least two of the comparison rules provide TRUE answers. In response to determining that at least two of the comparison rules provided TRUE answers, the method may continue by adjusting operation of the HVAC system to reduce and/or limit a temperature of the compressor.

Figure 8:
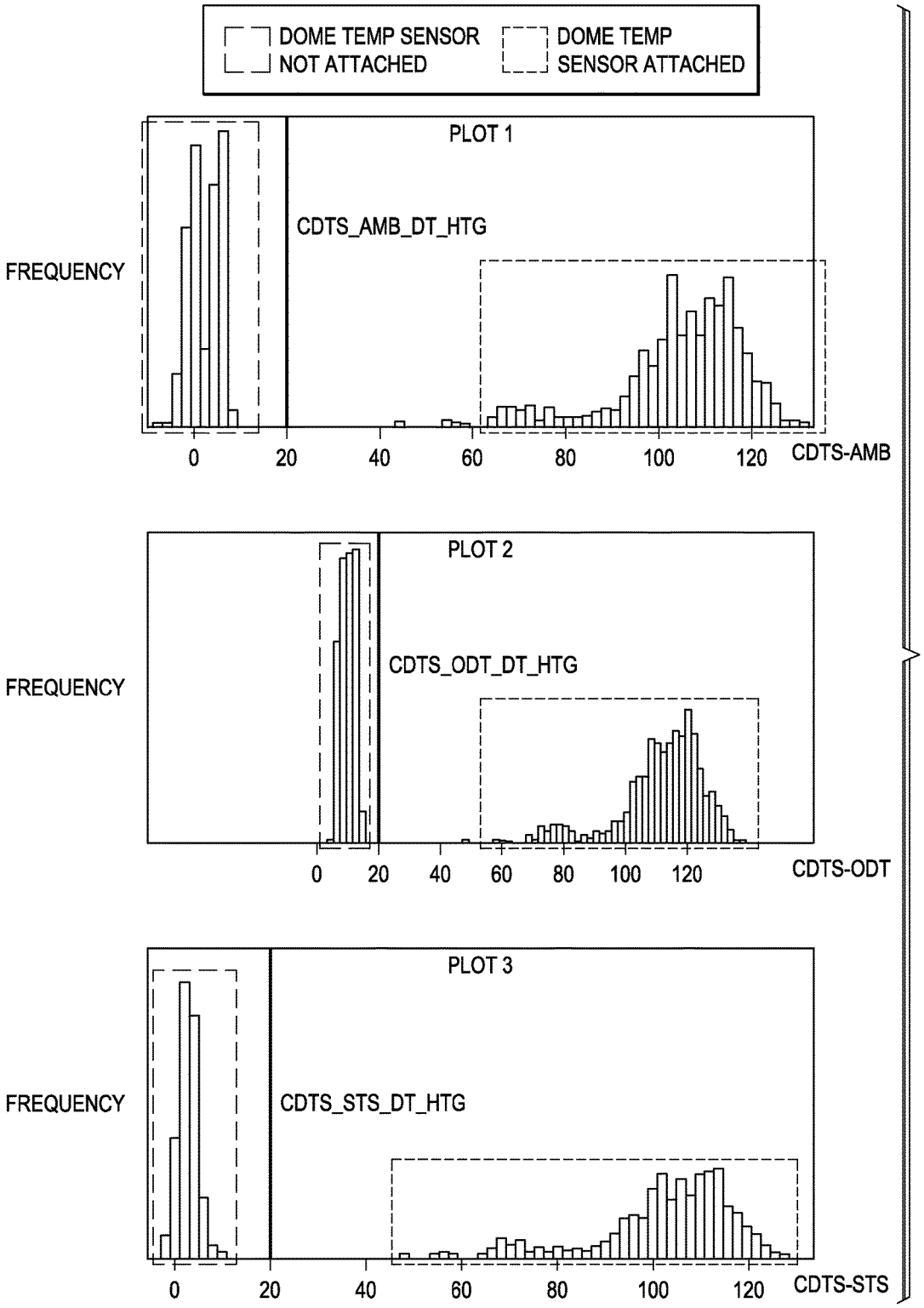
FIG. 8 is a set of a first, second, and third histogram plots showing temperature differentials between a compressor dome temperature sensor and each of an outdoor ambient temperature sensor, an outdoor heat exchanger temperature sensor, and a suction line temperature sensor, respectively.

Referring now to FIG. 8, a set of a first, second, and third histogram plots showing temperature differentials between temperatures sensed by a compressor dome temperature sensor 150 and each of an outdoor ambient temperature sensor 156, an outdoor heat exchanger temperature sensor 152, and a suction line temperature sensor 154, respectively, when operating an HVAC system such as HVAC system 100 in a heating mode. The histograms illustrate how comparison rules and counting rules may be applied to determine if the compressor dome temperature sensor 150 is in fact installed properly and likely measuring dome temperature appropriately. The three histograms represent data collected over several days of operation of an HVAC system: Plot 1 shows the temperature value difference in degrees Fahrenheit between the temperature indicated by output of the compressor dome temperature sensor 150 (CDTS) and the temperature indicated by output of the outdoor ambient temperature sensor 156 (AMB), Plot 2 shows the temperature value difference between CDTS and the temperature indicated by output of the outdoor heat exchanger temperature sensor 152 (ODT), and Plot 3 shows the difference between CDTS and the temperature indicated by output of the suction line temperature sensor 154 (STS). In all three histograms, data are shown for two distinct situations: the circled group of data to the left is generally indicative of the compressor dome temperature sensor 150 not being appropriately attached in proximity to the compressor dome 117 and the circled group of data to the right is generally indicative of the compressor dome temperature sensor 150 being properly attached in proximity to the compressor dome 117.

Using the data of FIG. 8, when the data circled on left are applied to compare the temperature reported by the compressor dome temperature sensor 150 to the temperature reported by the outdoor ambient temperature sensor 156, CDTS-AMB<CDTS_AMB_DT_HTG (20 F), a TRUE value or answer is yielded and counted to yield a count of Count=1. Similarly, when the data circled on the left are applied to compare the temperature reported by the compressor dome temperature sensor 150 to the temperature reported by the outdoor heat exchanger temperature sensor 152, CDTS-ODT<CDTS_ODT_DT_HTG (20 F), a TRUE value or answer is yielded and counted to increase the total count to Count=2. Further, when the data circled on left are applied to compare the temperature reported by the compressor dome temperature sensor 150 to the temperature reported by the suction line temperature sensor 154, CDTS-STS<CDTS_STS_DT_HTG (20 F), a TRUE value or answer is yielded and counted to increase the total count to Count=3. Next, in this embodiment, because the total count is equal or greater to 2, a DOME_TEMP_APP_FLAG may be set TRUE and an alert that the compressor dome temperature sensor 150 is not installed and/or located properly may be sent. In some embodiments, the alert may comprise presenting an alert to a user or technician via a user interface and/or display and/or the alert may comprise a trigger for altering operation of the compressor 116 to prevent temperature damage to the compressor 116. In alternative embodiments, such as when monitoring placement of the compressor dome temperature sensor, an HVAC system without an outdoor heat exchanger temperature sensor 152, the total count value required to cause issuance of an alert may be 1 or 2, for example.

Conversely, when the data circled on the right are applied to compare the temperature reported by the compressor dome temperature sensor 150 to the temperature reported by the outdoor ambient temperature sensor 156, CDTS-AMB<CDTS_AMB_DT_HTG (20 F), a FALSE value or answer is yielded and counted to yield a count of Count=0. Similarly, when the data circled on right are applied to compare the temperature reported by the compressor dome temperature sensor 150 to the temperature reported by the outdoor heat exchanger temperature sensor 152, CDTS-ODT<CDTS_ODT_DT_HTG (20 F), a FALSE value or answer is yielded and counted but the total count remains Count=0. Further, when the data circled on right are applied to compare the temperature reported by the compressor dome temperature sensor 150 to the temperature reported by the suction line temperature sensor 154, CDTS-STS<CDTS_STS_DT_HTG (20 F), a FALSE value or answer is yielded and counted still leaving the total count to Count=0. Next, in this embodiment, because the total count is not equal or greater to 2, a DOME_TEMP_APP_FLAG may be set to or remain FALSE so that no alert is generated and/or sent. In alternative embodiments, an alert may be generated and/or sent that indicates that the compressor dome temperature sensor 150 is installed and/or located properly. In some embodiments, the alert may comprise presenting an alert to a user or technician via a user interface and/or display without altering operation of the compressor 116.

Figure 9:
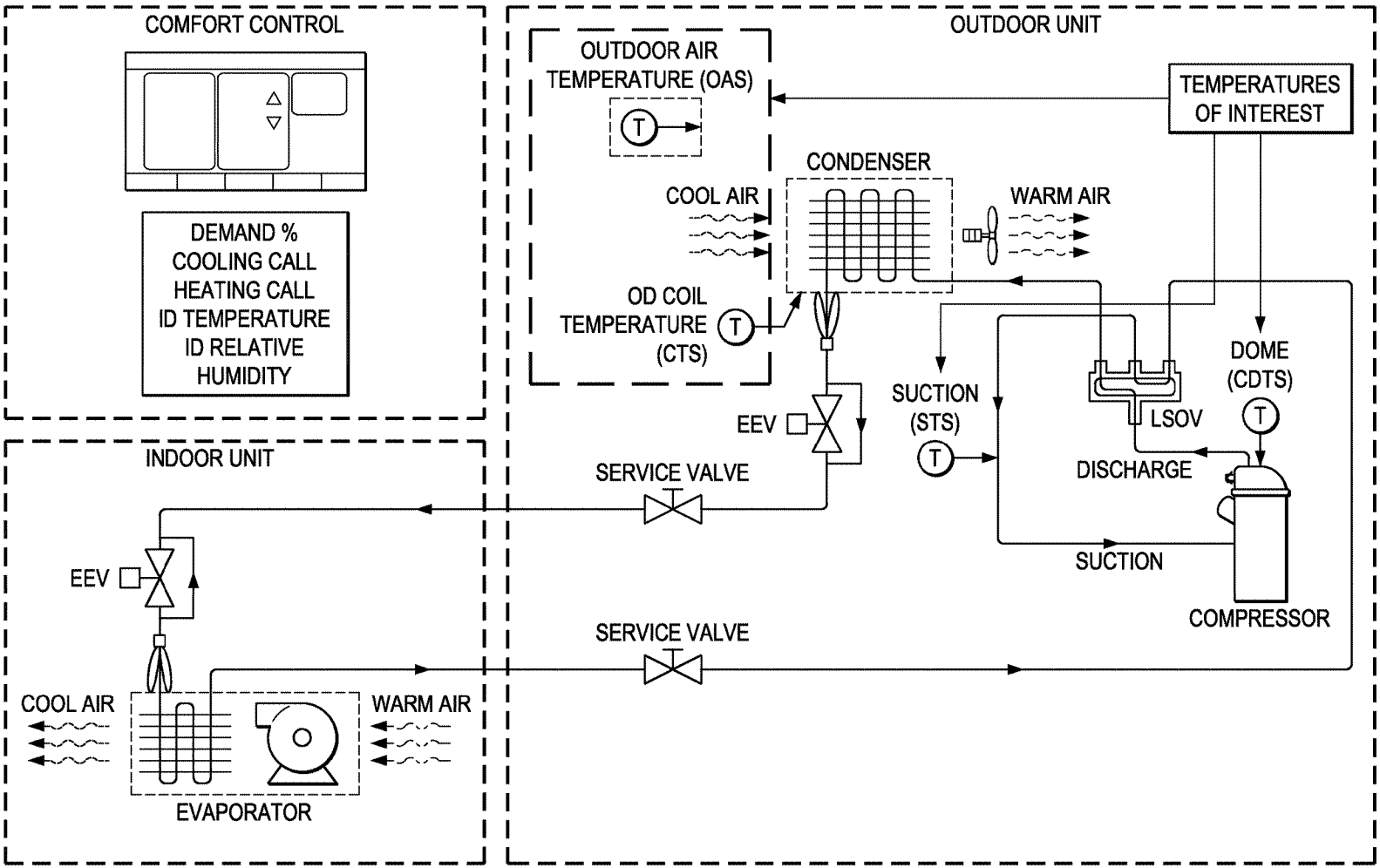
FIG. 9 is a schematic diagram of an HVAC system according to another embodiment of the disclosure.

Referring now to FIG. 9, an alternative embodiment of an HVAC system is disclosed that is substantially similar to HVAC system 100.

Figure 10:
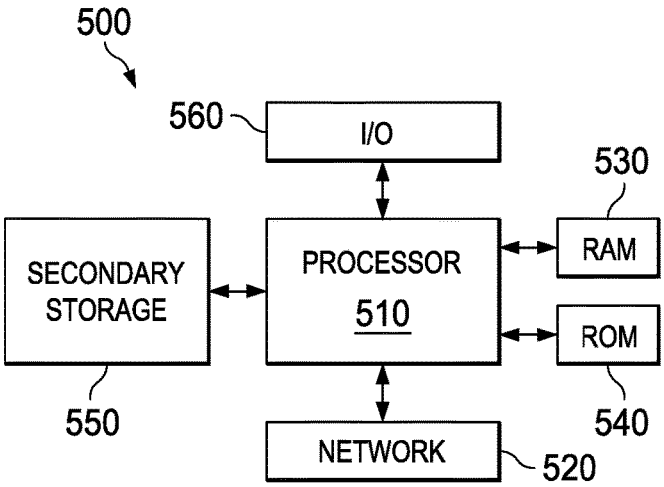
FIG. 10 illustrates a general-purpose computer system suitable for implementing the embodiments of the present disclosure.

Referring now to FIG. 10, the HVAC system 100 may comprise one or more processing components capable of executing instructions related to the methods and/or operation described herein. The processing component may be a component of a computer system. FIG. 5 illustrates a typical, general-purpose processor (e.g., electronic controller or computer) system 500 that includes a processing component 510 suitable for implementing one or more embodiments disclosed herein. In addition to the processor 510 (which may be referred to as a central processor unit or CPU), the system 500 might include network connectivity devices 520, random access memory (RAM) 530, read only memory (ROM) 540, secondary storage 550, and input/output (I/O) devices 560. In some cases, some of these components may not be present or may be combined in various combinations with one another or with other components not shown. These components might be located in a single physical entity or in more than one physical entity. Any actions described herein as being taken by the processor 510 might be taken by the processor 510 alone or by the processor 510 in conjunction with one or more components shown or not shown in the drawing.

The processor 510 executes instructions, codes, computer programs, or scripts that it might access from the network connectivity devices 520, RAM 530, ROM 540, or secondary storage 550 (which might include various disk-based systems such as hard disk, floppy disk, optical disk, or other drive). While only one processor 510 is shown, multiple processors may be present. Thus, while instructions may be discussed as being executed by a processor, the instructions may be executed simultaneously, serially, or otherwise by one or multiple processors. The processor 510 may be implemented as one or more CPU chips.

The network connectivity devices 520 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 520 may enable the processor 510 to communicate with the Internet or one or more telecommunications networks or other networks from which the processor 510 might receive information or to which the processor 510 might output information.

The network connectivity devices 520 might also include one or more transceiver components capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component might include separate receiving and transmitting units or a single transceiver. Information transmitted or received by the transceiver may include data that has been processed by the processor 520 or instructions that are to be executed by processor 510. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 530 might be used to store volatile data and perhaps to store instructions that are executed by the processor 510. The ROM 540 is a non-volatile memory device that typically has a smaller memory capacity than the memory capacity of the secondary storage 550. ROM 540 might be used to store instructions and perhaps data that are read during execution of the instructions. Access to both RAM 530 and ROM 540 is typically faster than to secondary storage 550. The secondary storage 550 is typically comprised of one or more disk drives or tape drives and might be used for non-volatile storage of data or as an over-flow data storage device if RAM 530 is not large enough to hold all working data. Secondary storage 550 may be used to store programs or instructions that are loaded into RAM 530 when such programs are selected for execution or information is needed.

The I/O devices 560 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, a transceiver might be considered to be a component of the I/O devices 560 instead of or in addition to being a component of the network connectivity devices 520. Some or all of the I/O devices 560 may be substantially similar to various components depicted in the previously described.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclsed herein.

What is claimed is:

1. A heating, ventilating, and air conditioning (HVAC) system, comprising:

a compressor;

a compressor dome temperature sensor;

a plurality of additional temperature sensors; and a controller configured to (i) control operating of the HVAC system in response to comparisons, by the controller, of information from the compressor dome temperature sensor and the plurality of additional temperature sensors indicating a likelihood that the compressor dome temperature sensor is not properly located, and (ii) track, with counting rules, a number of comparison rules that indicate that the compressor dome temperature sensor is improperly located, wherein at least two counts indicate that the compressor dome temperature sensor is improperly located.

2. The HVAC system of claim 1, wherein the controller is configured to provide a notification in response to determining the compressor dome temperature sensor is improperly located.

3. The HVAC system of claim 1, wherein the controller is configured to initiate a shutdown of the compressor in response to determining the compressor dome temperature sensor is improperly located.

4. The HVAC system of claim 1, wherein the controller is configured to reduce a runtime of the compressor in response to determining the compressor dome temperature sensor is improperly located.

5. The HVAC system of claim 1, wherein the controller is configured to operate the compressor at a lower speed in response to determining the compressor dome temperature sensor is improperly located.

6. The HVAC system of claim 1, wherein the controller is configured to reduce a power consumption of the compressor in response to determining the compressor dome temperature sensor is improperly located.

7. The HVAC system of claim 1, wherein the plurality of other temperature sensors comprise an outdoor ambient temperature sensor, an outdoor heat exchanger temperature sensor, and a suction line temperature sensor.

8. The HVAC system of claim 1, wherein the controller is configured to monitor each of the plurality of temperature sensors.

9. The HVAC system of claim 1, wherein the controller is configured to adjust operation of the HVAC system in response to at least two temperature comparisons not being satisfied.

10. The HVAC system of claim 1, wherein the controller is configured to adjust operation of the HVAC system to reduce a temperature of the compressor.

11. The HVAC system of claim 1, wherein the compressor dome temperature sensor is located on the compressor or a compressor discharge line.

12. A method of operating a heating, ventilation, and air conditioning (HVAC) system, comprising:

providing a compressor;

measuring a compressor dome temperature;

measuring a plurality of other temperatures;

comparing, using the controller, the compressor dome temperature to the plurality of other temperatures;

controlling operation of the HVAC system in response to the comparing the compressor dome temperature to the other temperatures indicating a likelihood that the compressor dome temperature sensor is not properly located; and tracking, with counting rules, a number of comparison rules that indicate that the compressor dome temperature sensor is improperly located, wherein at least two counts indicate that the compressor dome temperature sensor is improperly located.

13. The method of claim 12, further comprising:

providing a notification that the compressor dome temperature sensor is improperly located.

14. The method of claim 12, further comprising:

initiating a shutdown of the compressor in response to the likelihood that the compressor dome temperature sensor is not properly located.

15. The method of claim 12, further comprising:

reducing a runtime of the compressor in response to the likelihood that the compressor dome temperature sensor is not properly located.

16. The method of claim 12, further comprising:

operating the compressor at a lower speed in response to the likelihood that the compressor dome temperature sensor is not properly located.

17. The method of claim 12, further comprising:

reducing a power consumption of the compressor in response to the likelihood that the compressor dome temperature sensor is not properly located.

18. The method of claim 12, wherein the plurality of other temperatures comprise an outdoor ambient temperature, an outdoor heat exchanger temperature, and a suction line temperature.

19. The method of claim 12, wherein the controlling operation of the HVAC system in response to the comparing the compressor dome temperature to the other temperatures indicating a likelihood that the compressor dome temperature sensor is not properly located is in response to at least two temperature comparisons not being satisfied.

20. The method of claim 12, wherein the controlling operation of the HVAC system in response to the comparing the compressor dome temperature to the other temperatures indicating a likelihood that the compressor dome temperature sensor is not properly located is to adjust operation of the HVAC system to reduce a temperature of the compressor.

21. The method of claim 12, wherein the compressor dome temperature sensor is located on the compressor or a compressor discharge line.

22. A controller for a heating, ventilating, and air conditioning (HVAC) system, comprising:

at least one processor configured to:

monitor a compressor dome temperature using a compressor dome temperature sensor, wherein the compressor dome temperature sensor is located on a compressor of the HVAC system or a compressor discharge line;

monitor a plurality of other temperatures;

compare the compressor dome temperature to the plurality of other temperatures;

control operation of a compressor of the HVAC system in response to the comparison of the compressor dome temperature to the other temperatures indicating a likelihood that the compressor dome temperature sensor is not properly located; and track, with counting rules, a number of comparison rules that indicate that the compressor dome temperature sensor is improperly located, wherein at least two counts indicate that the compressor dome temperature sensor is improperly located.

* * * * *